US008290383B2

(12) United States Patent
Fujita

(10) Patent No.: US 8,290,383 B2
(45) Date of Patent: Oct. 16, 2012

(54) IMAGE FORMING APPARATUS WHICH CONTROLS A TRANSFER VOLTAGE APPLIED TO A TRANSFER MEMBER

(75) Inventor: Naohisa Fujita, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 1189 days.

(21) Appl. No.: 11/601,621

(22) Filed: Nov. 20, 2006

(65) Prior Publication Data

US 2007/0253722 A1 Nov. 1, 2007

(30) Foreign Application Priority Data

Apr. 27, 2006 (JP) ..... 2006-123925

(51) Int. Cl.
*G03G 15/16* (2006.01)

(52) U.S. Cl. ..... 399/66

(58) Field of Classification Search ..... 399/66, 399/43–45, 94, 97, 298, 303
See application file for complete search history.

(56) References Cited

U.S. PATENT DOCUMENTS

| | | | | |
|---|---|---|---|---|
| 5,930,556 | A * | 7/1999 | Imamiya | 399/66 |
| 6,389,260 | B1 * | 5/2002 | Kataoka et al. | 399/298 |
| 6,477,339 | B1 * | 11/2002 | Yano et al. | 399/66 |
| 6,650,861 | B2 | 11/2003 | Inukai et al. | |
| 6,701,116 | B1 * | 3/2004 | Aoki | 399/298 |
| 2003/0185581 | A1 * | 10/2003 | Hisada | 399/45 |
| 2004/0131373 | A1 * | 7/2004 | Saito et al. | 399/66 |
| 2004/0228659 | A1 | 11/2004 | Nishida | |
| 2004/0253013 | A1 * | 12/2004 | Furukawa | |

FOREIGN PATENT DOCUMENTS

| | | | |
|---|---|---|---|
| JP | 04324870 | A * | 11/1992 |
| JP | 9-281768 | A | 10/1997 |
| JP | 10207257 | A * | 8/1998 |
| JP | 11-119562 | A | 4/1999 |
| JP | 2000274424 | A * | 10/2000 |
| JP | 2001-183889 | A | 7/2001 |
| JP | 2002-116641 | A | 4/2002 |
| JP | 2002-156847 | A | 5/2002 |

(Continued)

OTHER PUBLICATIONS

English Translation of JP 2001-183889A.*

(Continued)

*Primary Examiner* — Walter L Lindsay, Jr.
*Assistant Examiner* — Milton Gonzalez
(74) *Attorney, Agent, or Firm* — Sughrue Mion, PLLC

(57) ABSTRACT

A tandem electrophotographic image forming apparatus includes plural toner image forming units and a fixing unit. The plural toner image forming units are disposed in a conveyance direction of a printing medium. Each of the toner image forming units includes a photoreceptor on which a toner image is formed and a transfer member to which a transfer voltage is applied to cause the toner image to be transferred from the photoreceptor onto the printing medium. The fixing unit is disposed on a downstream side of the toner image forming units in the conveyance direction of the printing medium and heats and fixes, to the printing medium, the toner images that have been transferred onto the printing medium. The transfer voltages applied to the transfer members are made smaller the closer to the fixing unit.

5 Claims, 5 Drawing Sheets

FOREIGN PATENT DOCUMENTS

| | | | | |
|---|---|---|---|---|
| JP | 2002148960 | A | * | 5/2002 |
| JP | 2002202671 | A | | 7/2002 |
| JP | 200315440 | A | | 1/2003 |
| JP | 2003207975 | A | * | 7/2003 |
| JP | 2003-241543 | A | | 8/2003 |
| JP | 2004-310064 | A | | 11/2004 |
| JP | 2005156972 | A | | 6/2005 |
| JP | 2005292549 | A | * | 10/2005 |

OTHER PUBLICATIONS

English Translation of JP 2001-183889 A, Jul. 6, 2001.*

Japanese Patent Office Action mailed May 17, 2011 and English-language translation thereof.

Japanese Patent Office Action dated Nov. 22, 2011 and English-language translation thereof.

* cited by examiner

| | L/L ENVIRONMENT DURING SMALL QUANTITY PRINTING | L/L ENVIRONMENT AFTER LARGE QUANTITY PRINTING | N/N ENVIRONMENT DURING SMALL QUANTITY PRINTING | N/N ENVIRONMENT AFTER LARGE QUANTITY PRINTING | H/H ENVIRONMENT DURING SMALL QUANTITY PRINTING | H/H ENVIRONMENT AFTER LARGE QUANTITY PRINTING |
|---|---|---|---|---|---|---|
| FIRST COLOR (Y) | 8.50 | 8.15 | 7.50 | 7.45 | 6.60 | 7.00 |
| SECOND COLOR (M) | 8.47 | 8.05 | 7.48 | 7.40 | 6.60 | 6.99 |
| THIRD COLOR (C) | 8.43 | 7.95 | 7.46 | 7.35 | 6.60 | 6.98 |
| FOURTH COLOR (K) | 8.38 | 7.75 | 7.43 | 7.25 | 6.59 | 6.97 |

FIG.3

VOLTAGE STEP AMOUNTS WITH WHICH MAXIMUM TRANSFER LATITUDE CAN BE OBTAINED (FROM EXPERIMENTAL RESULTS)

| | FIRST COLOR PRINTING BIAS VOLTAGE | STEP AMOUNT |
|---|---|---|
| L/L ENVIRONMENT | DURING SMALL QUANTITY PRINTING 2500 V | -100 V |
| | AFTER LARGE QUANTITY PRINTING 2000 V | -200 V |
| N/N ENVIRONMENT | DURING SMALL QUANTITY PRINTING 1500 V | 0V |
| | AFTER LARGE QUANTITY PRINTING 1500 V | -100 V |
| H/H ENVIRONMENT | DURING SMALL QUANTITY PRINTING 800 V | 0V |
| | AFTER LARGE QUANTITY PRINTING 1200 V | 0V |

IMAGE FORMING APPARATUS WHICH CONTROLS A TRANSFER VOLTAGE APPLIED TO A TRANSFER MEMBER

BACKGROUND

1. Technical Field

The present invention relates to an image forming apparatus, and in particular to an image forming apparatus that forms an image by developing, with toner, electrostatic latent images formed on plural image carriers and transferring the resulting toner images to a transfer medium.

2. Related Art

Conventionally, among image forming apparatus such as laser printers, facsimile machines, and copiers, there has been an image forming apparatus disposed with a photoreceptor drum serving as an image carrier, in which the surface of the photoreceptor drum is uniformly charged and irradiated with a light beam based on image data to form an electrostatic latent image on the photoreceptor drum, the electrostatic latent image is developed using toner charged to a predetermined polarity, and the image developed on the photoreceptor drum is transferred to a transfer medium (paper) using a transfer member such as a transfer roll to form an image.

In order to precisely transfer the charged toner to the paper at this time, it is necessary to cause the transfer member to generate a predetermined transfer electric field and for the transfer electric field to be stabilized by transfer bias control.

Further, in the case of a paper conveying tandem color image forming apparatus disposed with plural photoreceptor drums and transfer members along the conveyance path of the transfer medium, it is necessary to change the voltage applied to each of the transfer members and to change the electric field of each of the transfer members as the paper is conveyed and the toner images are superposed and formed.

In the case of the paper conveying tandem color image forming apparatus, the voltages applied to the transfer members may be gradually raised proceeding downstream along the paper conveyance path.

Incidentally, with respect to the material of the transfer rolls, conventionally transfer rolls or the like in which carbon black is dispersed have been used, but because there are large variations in their resistance values per product, recently ion conductive transfer rolls are being used. Ion conductive transfer rolls have the characteristics that there are small variations in their resistance values between products and their electric resistance drops as their temperature rises.

In a conveyor belt system where a fixer is disposed in the vicinity of the outlet and which has a layout proceeding upward in a substantially vertical direction, it is easy for the upper side transfer rolls, that is the downstream transfer rolls, to be affected by the fixing heat. When ion conductive transfer rolls are used, the temperatures of the upper side transfer rolls rise due to the fixing heat and their electric resistances become smaller. When the transfer electric fields of the transfer rolls are raised from upstream to downstream along the paper conveyance path in this state, the downstream transfer rolls come to have an excessive transfer electric field, which leads to image quality defects.

When the distance between the transfer rolls and the fixer is increased so that the transfer rolls are not affected by the fixing heat, the entire apparatus inevitably becomes larger. And even though an example has been described here where the transfer members comprise transfer rolls, the same is true of film-like members and brush-like members that are ion conductive.

SUMMARY

A first aspect of the present invention is a tandem electrophotographic image forming apparatus including: plural toner image forming units disposed in a conveyance direction of a printing medium, each of the toner image forming units including a photoreceptor on which a toner image is formed and a transfer member to which a transfer voltage is applied to cause the toner image to be transferred from the photoreceptor onto the printing medium; and a fixing unit disposed at the downstream side of the toner image forming units in the conveyance direction of the printing medium, the fixing unit heating and fixing the toner images that have been transferred onto the printing medium. The transfer voltages applied to the transfer members are controlled on the basis of predetermined conditions.

BRIEF DESCRIPTION OF THE DRAWINGS

An embodiment of the present invention will be described in detail based on the following figures, wherein:

FIG. 3 is a table showing amounts of variation in voltages applied to the transfer rolls in the image forming apparatus pertaining to an embodiment of the present invention;

DESCRIPTION

<Basic Configuration>

Figure 1:
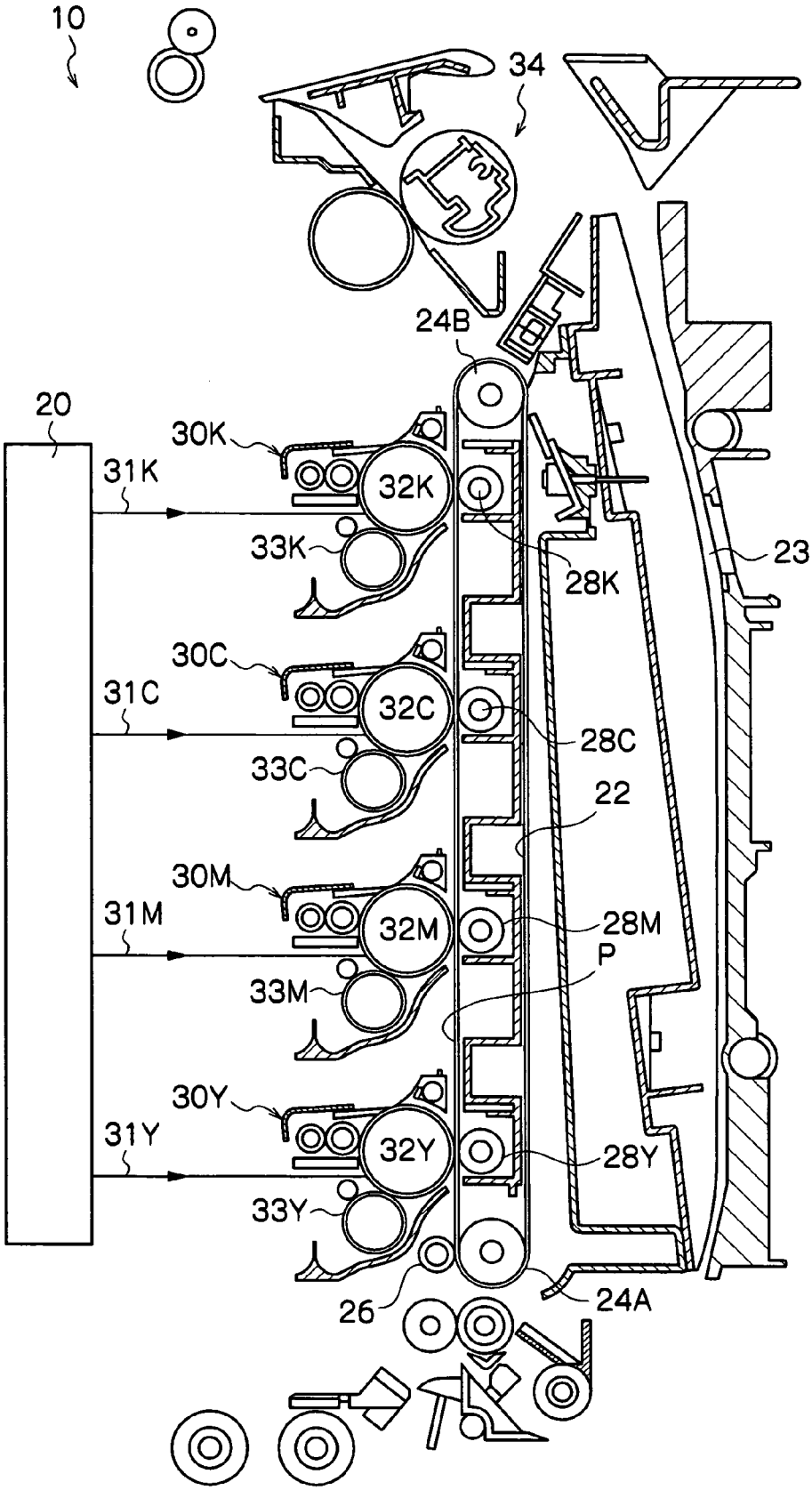
FIG. 1 is a cross-sectional view showing an image forming apparatus pertaining to an embodiment of the present invention.

FIG. 1 shows a full color laser beam printer disposed with an image forming apparatus 10 pertaining to an exemplary embodiment of the present invention.

As shown in FIG. 1, the main portions of the image forming apparatus 10 are configured by: developing devices 30Y to 30K that include photoreceptor drums 32Y to 32K for yellow (Y), magenta (M), cyan (C) and black (K); charge rolls for primary charging that contact the photoreceptor drums 32Y to 32K; and a raster output scanner (abbreviated as "ROS" below) 20 that irradiates the photoreceptor drums 32Y to 32K with laser light beams 31Y to 31K of the respective colors of yellow (Y), magenta (M), cyan (C) and black (K).

The developing devices 30Y to 30K and a fixer 34 are disposed from below to above in a substantially vertical direction along a conveyance path of paper P, that is, along a conveyor belt 22. Thus, the image forming apparatus 10 is compactly configured and includes a discharge tray into which the paper P is discharged and which is disposed in the easily-accessible upper portion of the apparatus.

The photoreceptor drums 32Y, 32M, 32C and 32K are arranged at constant intervals so as to have a common tangential plane. Signals corresponding to image information for each of the colors are inputted to the ROS 20 by an unillustrated image processing unit. The ROS 20, which serves as an exposure device, modulates laser light beams of the respective colors of yellow (Y), magenta (M), cyan (C) and black (K) and irradiates the photoreceptor drums 32Y to 32K of the corresponding colors with these laser light beams.

The photoreceptor drums 32Y to 32K perform an image forming process for each of the colors by the known electrophotographic format. First, photoreceptor drums using an organic photoreceptor, for example, are used as the photoreceptor drums 32Y to 32K, and these photoreceptor drums 32Y to 32K are driven to rotate. The surfaces of the photoreceptor drums 32Y to 32K are charged to about −300 V, for example, as a result of DC voltages being applied thereto by the charge rolls.

The surfaces of the photoreceptor drums 32Y to 32K, to which surface electric potentials have been applied, are irradiated by the ROS 20 with the laser light beams 31Y to 31K corresponding to the respective colors of yellow (Y), magenta (M), cyan (C) and black (K), whereby electrostatic latent images corresponding to the inputted image information for each of the colors are formed on the surfaces of the photoreceptor drums 32Y to 32K. The ROS 20 irradiates the surfaces of the photoreceptor drums 32Y to 32K with the laser light beams 31Y to 31K and writes images on the surfaces of the photoreceptor drums 32Y to 32K so that, with respect to the surface electric potentials of the image exposed portions on the photoreceptor drums 32Y to 32K, the image portions—that is, the exposed places—are destaticized and electrostatic latent images are formed.

Next, the electrostatic latent images corresponding to the respective colors of yellow (Y), magenta (M), cyan (C) and black (K) formed on the surfaces of the photoreceptor drums 32Y to 32K are developed by the developing devices 30Y to 30K of the corresponding colors and made visible on the photoreceptor drums 32Y to 32K as toner images of the respective colors of yellow (Y), magenta (M), cyan (C) and black (K).

The developing devices 30Y to 30K are filled with developing agents comprising carriers and toners of the colors of yellow (Y), magenta (M), cyan (C) and black (K). Unillustrated toner replenishing devices replenish the developing devices 30Y to 30K with the toners, and the replenished toners are sufficiently stirred together with the carriers and frictionally charged by augers inside the developing devices 30Y to 30K.

As for the toners which have been stirred together with the carriers, frictionally charged, and supplied to developing rolls 33Y to 33K, magnetic brushes configured by the carriers and the toners are formed by the magnetic force of magnet rolls. The magnetic brushes contact the photoreceptor drums 32Y to 32K. Development bias voltages are applied to the developing rolls 33Y to 33K, and the toners on the developing rolls 33Y to 33K are transferred to the electrostatic latent images formed on the photoreceptor drums 32Y to 32K, whereby toner images of the respective colors of yellow (Y), magenta (M), cyan (C) and black (K) are formed.

The paper P is fed from an unillustrated tray and conveyed on the conveyor belt 22, which is suspended on rolls 24A and 24B. The toner images are transferred onto the paper P, whereby a color image is formed on the paper P. That is, the toner images of the respective colors of yellow (Y), magenta (M), cyan (C) and black (K) formed on the photoreceptor drums 32Y to 32K are aligned, superposed, and transferred onto the paper P.

When the paper P is attracted to and retained on the conveyor belt 22 by an attracting roll 26 and conveyed to a position where the paper P is nipped between the conveyor belt 22 and the photoreceptor drum 32Y, the paper P is pressed against the photoreceptor drum 32Y by a transfer roll (bias transfer roll, or BTR) 28Y at a position facing the photoreceptor drum 32Y with the conveyor belt 22 sandwiched therebetween, and the simultaneously charged Y color toner is transferred to the paper P by a predetermined transfer voltage applied to the transfer roll 28Y as described later.

It is preferable to use ion conductive transfer rolls for the transfer rolls 28Y to 28K in order to control variations in the resistance values of the four transfer rolls. An ammeter that detects electric current flowing in response to the applied voltage is disposed in the transfer roll 28Y, so that the resistance of the transfer roll 28Y at that point of the voltage application can be calculated from the applied voltage and electric current.

In the present invention, the other transfer rolls 28M to 28K of the colors other than yellow are not disposed with members that measure their resistance values, but this does not matter because the resistance values of the other transfer rolls 28M to 28K can be supposed on the basis of numerical values obtained by detectors such as temperature and humidity sensors and process counters disposed. Such detectors are provided in order to acquire the affects of environmental conditions such as the temperature and humidity inside and outside the apparatus and conditions such as the number of process sheets.

The colors of cyan (C), magenta (M) and black (K) are transferred onto the single color image of yellow (Y) on the paper P along the conveyance path of the paper P, whereby a final full-color toner image is formed as a four-layer color image.

Finally, the full-color toner image formed on the paper P is heated by the fixer 34 and fixed to the paper P, and the series of image forming processes ends.

Here, in the exemplary embodiment of the present invention, the image forming apparatus 10 is configured as a printer capable of printing on both sides of the paper. That is, after an image has been fixed on one side of the paper P, the paper is passed along an inversion path 23, returned to the front of the attracting roll 26, and again caused to be attracted to the conveyor belt 22, whereby toner image formation is performed on both sides of the paper P, that is, toner image formation is performed on the other side where image formation had not been performed.

<Transfer Roll Resistance Variations and Applied Voltages>

Figures 2A, 2B:
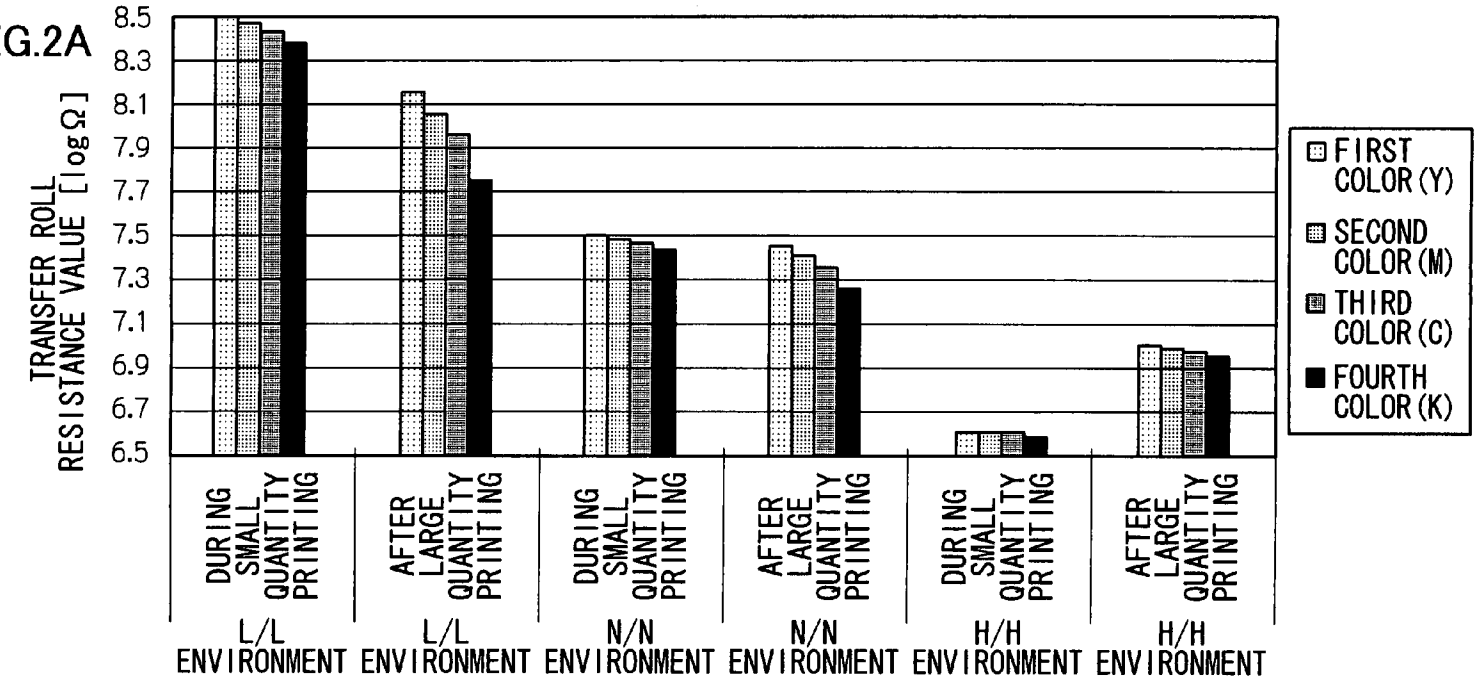
FIGS. 2A and 2B are diagrams showing variations in resistance values of transfer rolls in the image forming apparatus pertaining to an embodiment of the present invention.

FIGS. 2A, 2B, and 3 show amounts of variations differentiated by conditions of electric resistances and applied voltages of the transfer rolls (BTR) pertaining to the present embodiment.

A low temperature with low humidity environment is represented by L/L (10° C., 15% RH), a normal temperature with normal humidity environment is represented by N/N (22° C., 55% RH), and a high temperature with high humidity environment is represented by H/H (28° C., 85% RH), and the electric resistances of the transfer rolls 28Y to 28K of the respective colors of Y, M, C and K during small quantity printing (10 sheets) and large quantity printing (continuous processing, 1000 sheets) in these environments are shown in a bar graph in FIG. 2A and in a numerical table in FIG. 2B.

Further, FIG. 3 shows step amounts of voltage values applied to the transfer roll 28 of the first (Y) color and transfer voltages applied to the transfer rolls 28 of the second (M) to fourth (K) colors with which the maximum transfer latitudes (density bandwidths) can be obtained in the cases of the above-described environmental conditions and numbers of process sheets.

As shown in FIG. 2A, the resistance values of the transfer rolls 28 become lower from the first color (Y) to the fourth color (K) regardless of the environmental condition and number of process sheets. That is, although there are some differences, the tendency for the resistance values to become lower the closer transfer roll 28 is to the fixer 34 is common. When the transfer voltages are sequentially made larger from the upstream side to the downstream side in this state, there is the potential for too much voltage to flow in the downstream transfer rolls whose resistance values are low.

In the present embodiment, in order to avoid this situation, the transfer voltages of the transfer rolls 28 are set to become lower the closer the transfer rolls 28 are to the fixer 34, such that the values of the transfer voltages become appropriate for each of the environmental conditions and numbers of process sheets, to thereby prevent image quality defects resulting from too much voltage flow.

It is learned that, in the L/L environment where the temperature and humidity inside and outside the apparatus are low, the variations in the resistances of the transfer rolls 28 of the respective colors are large between small quantity printing and large quantity printing, and during small quantity printing, the resistance values are smaller in comparison to during large quantity printing. Further, the differences in the resistance values between the transfer rolls 28 of the respective colors during small quantity printing or during large quantity printing are also large. The drop in the resistance value of the transfer roll 28K of the K color closest to the fixer 34 is particularly remarkable.

In a low temperature with low humidity environment and when the number of process sheets is large, this is thought to be the result of temperature differences between the transfer rolls 28 becoming larger due to the affect of the heat generated by the fixer 34 increasing and the temperature gradient inside the apparatus becoming larger.

For this reason, in the L/L environment (low temperature with low humidity), the transfer voltages applied to the transfer rolls 28 of the respective colors of Y to K are made lower as the number of process sheets increases. Further, it is particularly necessary to set the transfer voltage low with respect to the drop in the resistance value of the black transfer roll 28K so as to accommodate the increase in the differences of the resistance values between the transfer rolls 28 of the respective colors.

That is, in the L/L environment (low temperature low humidity), in accordance with the increase in the number of process sheets, control is performed to lower the voltages applied to the transfer rolls 28 of the respective colors while maintaining the relationship of Y>M>C>K for the voltage application control and in particular, to lower the transfer voltage applied to the transfer roll 28K of the K color such that Y>M>C>>K.

As shown in FIG. 3, during small quantity printing in the L/L environment (low temperature low humidity), the bias voltage value applied to the transfer roll 28 of the first (Y) color with which the maximum transfer latitude can be obtained is 2500 V, and the applied voltages are lowered about 100 V each such that M>C>K so that the maximum transfer latitude can be obtained with respect to each color.

During large quantity printing in the L/L environment (low temperature low humidity), the resistances of the transfer rolls 28 of the respective colors drop due to the affect of the heat of the fixer 34, so the bias voltage value applied to the transfer roll 28 of the first (Y) color becomes about 2000 V, the differences in the resistance values between the transfer rolls 28 of the respective colors increases twofold in comparison to during small quantity printing, and the applied voltages are lowered about 200 V each so that the maximum transfer latitude can be obtained with respect to each color.

Or, as shown in FIG. 2A, given that the drop in the resistance value of the transfer roll 28 of the K color closest to the fixer 34 is particularly large, rather than equally lowering the transfer voltages of the transfer rolls 28 of the respective colors, the amount that the voltage of the transfer roll 28 of the K color is lowered may be set large so that more accurate control can be performed.

Next, in the N/N environment (normal temperature with normal humidity), the variations in the resistances of the transfer rolls 28 of the respective colors during small quantity printing and large quantity printing are small in comparison to the L/L environment. Further, during small quantity printing, the resistances of the transfer rolls 28 of the respective colors can be regarded as being substantially the same.

However, the differences in the resistance values between the transfer rolls 28 of the respective colors become larger as the number of process sheets increases. The drop in the resistance value of the transfer roll 28K of the K color closest to the fixer 34 is particularly large.

For this reason, in the N/N environment (normal temperature with normal humidity), it is not really necessary to change the transfer voltage applied to the transfer roll 28Y of the Y color with respect to the increase in the number of process sheets. However, it is necessary to decreasingly set the transfer voltages low with respect to the drop in the resistance values of the transfer rolls 28 of the M to K colors.

That is, in the N/N environment (normal temperature with normal humidity), the voltages applied to the transfer rolls 28 of the respective colors are controlled in accordance with the increase in the number of process sheets such that the transfer voltages applied to the transfer rolls 28 of the M to K colors are lowered as Y>M>C>K as the number of process sheets increases. The transfer voltages are controlled to maintain the relationship of Y≈M≈C≈K during small quantity printing.

That is, as shown in FIG. 3, during small quantity printing in the N/N environment (normal temperature with normal humidity), the bias voltage value applied to the transfer roll 28 of the first (Y) color with which the maximum transfer latitude can be obtained is about 1500 V, and voltages are applied with the same value to the other transfer rolls 28 of the respective colors so that the maximum transfer latitude can be obtained with respect to each color.

In contrast, during large quantity printing in the N/N environment (normal temperature with normal humidity), the bias voltage value applied to the transfer roll 28 of the first (Y) color is about 1500 V that is same to the voltage during small quantity printing, but because the resistances of the transfer rolls 28 of the respective colors drop due to the affect of the heat of the fixer 34 and the differences in the resistance values between the transfer rolls 28 of the respective colors become larger, the applied voltages are lowered about 100 V each so that the maximum transfer latitude can be obtained with respect to each color.

Or, as shown in FIG. 2A, given that the drop in the resistance of the transfer roll 28 of the K color closest to the fixer 34 is particularly large, rather than equally lowering the transfer voltages of the respective colors, the amount that the voltage of the transfer roll 28 of the K color is lowered may be set large so that more accurate control can be performed.

Finally, in the H/H environment (high temperature with high humidity), with respect to the variations in the resistances of the transfer rolls 28 of the respective colors during small quantity printing and large quantity printing, opposite from the L/L environment and the N/N environment, the resistances become larger as the number of process sheets increases.

Further, the resistance values between the transfer rolls 28 of the respective colors become smaller proceeding downstream from the Y color to the K color, but those differences are extremely small. Further, the drop in the resistance value of the transfer roll 28K of the K color closest to the fixer 34 is also about the same as the drop in the resistance values between the transfer rolls of the other colors.

The reason for this is, because of the high temperature with high humidity environment, in a state where the number of process sheets is low, the transfer rolls 28 of the respective colors are affected by the high humidity and their electric resistances become low. It is thought that when the number of process sheets increases, the heat of the fixer 34 affects the transfer rolls 28 of the respective colors so as to drop humidity rather than rise temperature, thereby the electric resistances of the transfer rolls 28 increase.

For this reason, in the H/H environment (high temperature with high humidity), opposite from the L/L environment and the N/N environment, it is necessary to set the transfer voltages applied to the transfer rolls 28 of the respective colors high as the number of process sheets increases.

Further, the differences in the resistance values between the transfer rolls 28 of the respective colors are small, and even if the number of process sheets increases, the differences do not become that much larger.

That is, in the H/H environment (high temperature with high humidity), rather than changing the transfer voltages applied to the transfer rolls 28 of the respective colors, control is performed to increase the voltages applied to the transfer rolls 28 of the respective colors as the number of process sheets increases while maintaining the relationship of Y≈M≈C≈K.

That is, as shown in FIG. 3, during small quantity printing in the H/H environment (high temperature with high humidity), the bias voltage value applied to the transfer roll 28 of the first (Y) color with which the maximum transfer latitude can be obtained is about 800 V, which is low, and voltages are applied with the same value (=step change amount 0) to the other transfer rolls 28 of the respective colors so that the maximum transfer latitude can be obtained with respect each color.

In contrast, during large quantity printing in the H/H environment (high temperature with high humidity), because the resistances of the transfer rolls 28 of the respective colors increase opposite from the L/L environment and the N/N environment due to the affect of the heat of the fixer 34, the bias voltage value applied to the transfer roll 28 of the first (Y) color is raised to about 1200 V and voltages of the same value are also applied to the transfer rolls 28 of the other respective colors so that the maximum transfer latitude can be obtained with respect each color.

In the present embodiment, the above-described control method is used to in principle lower the voltages applied to the transfer rolls 28 the closer the transfer roll 28 is to the fixer 34 from the upstream to the downstream in the paper conveyance direction, so that image quality defects resulting from excessive or insufficient transfer voltage can be prevented and an image forming apparatus with a wide transfer latitude can be provided.

Further, appropriate transfer voltages can be set by deciding the bias voltage value applied to the transfer roll of the first color and step values corresponding to the transfer rolls 28 of the respective colors from the second color. That is, accurate control can be performed with a simple configuration.

Even more accurate transfer voltage setting can be performed by performing control to greatly lower the transfer voltage of the fourth color (K) because the affect of the heat of the fixer on the transfer roll 28 of the fourth color (K) positioned close to the fixer is particularly large.

Due to the above-described control method, the affect of the heat of the fixer on the transfer rolls 28 can be corrected without increasing the size of the apparatus.

It will be noted that an ammeter may be disposed at the transfer roll 28Y of the first (Y) color so that the voltages applied to the transfer rolls 28 may be controlled on the basis of measurement result.

Since the transfer roll 28Y of the first (Y) color is least affected by the heat of the fixing unit, the measurement result is useful for the transfer voltage control.

Figure 4:
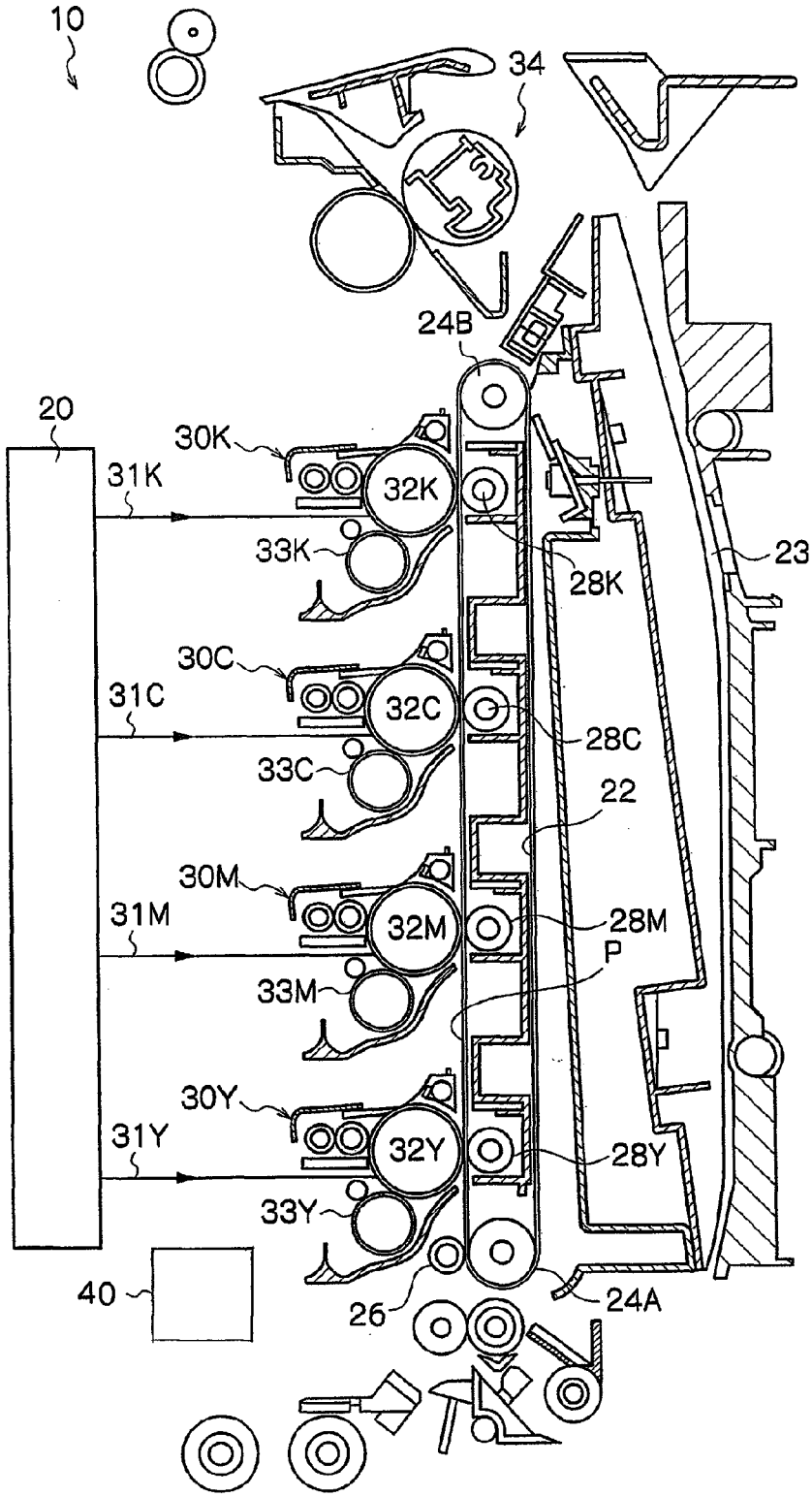
FIG. 4 is a cross-sectional view showing an image forming apparatus pertaining to a non-limiting embodiment of the present invention.

It will be noted that an environment detector 40 that detects environmental conditions such as the temperature and humidity inside the image forming apparatus may be disposed so that the voltages applied to the transfer members may be controlled on the basis of the environmental conditions that the environment detector 40 has detected (as shown in FIG. 4).

The resistance values of the transfer rolls 28 are calculated from an electric current measurement obtained by the ammeter disposed at the transfer roll 28Y as well as factors such as the environmental temperature and the number of process sheets, transfer voltage is controllable appropriately.

Additionally, the number of parts in the apparatus can be reduced and the apparatus becomes inexpensive.

By adding as factors environmental conditions such as temperature and humidity and the number of process sheets, it is possible to accommodate temperature changes inside the apparatus from when the apparatus is started to during large quantity processing and transfer voltages can be corrected more appropriately. Moreover, detailed transfer voltage control becomes possible for each environmental condition resulting from places where the apparatus is installed and the seasons.

Further, in the present embodiment, a constant current circuit is not required because the above-described transfer voltage control method is provided, so that an image forming apparatus with a simple configuration can be provided.

An embodiment of the present invention has been described above, but the present invention is not limited to the preceding embodiment and can of course be implemented in various ways in a range that does not deviate from the gist of the invention.

For example, in the present embodiment, a four-color full-color laser beam printer was mentioned as an exemplary example, but the invention is not limited to this and may of course also be applied to a printer of three or less colors or five or more colors.

Or, the color order for transfer does not have to invariably be YMCK and may also be another color order.

According to first aspect of the invention, the voltages applied to the transfer members are controlled on the basis of the predetermined conditions. Thus, an image forming apparatus with a wide transfer latitude can be provided.

A second aspect of the present invention is a tandem electrophotographic image forming apparatus including: plural toner image forming units disposed in a conveyance direction of a printing medium, each of the toner image forming units including a photoreceptor on which a toner image is formed and a transfer member to which a transfer voltage is applied to cause the toner image to be transferred from the photoreceptor onto the printing medium; and a fixing unit disposed at the downstream side of the toner image forming units in the conveyance direction of the printing medium, the fixing unit heating and fixing the toner images that have been transferred onto the printing medium, and the transfer voltages applied to the transfer members are made lower the closer the transfer member is to the fixing unit.

According to the above aspect, the applied voltages are made lower the closer the transfer member is to the fixing unit and made lower in the transfer members most easily affected by the heat of the fixing unit. Thus, an image forming apparatus with a wide transfer latitude and which prevents excessive transfer electric fields can be provided.

A third aspect of the present invention is a tandem electrophotographic image forming apparatus including: plural toner image forming units disposed in a conveyance direction of a printing medium, each of the toner image forming units including a photoreceptor on which a toner image is formed and a transfer member to which a transfer voltage is applied to cause the toner image to be transferred from the photoreceptor onto the printing medium; and a fixing unit disposed at the downstream side of the toner image forming units in the conveyance direction of the printing medium, the fixing unit heating and fixing the toner images that have been transferred onto the printing medium, and the transfer voltage applied to the transfer member that is provided closest to the fixing unit being made smallest in the transfer voltages applied to the transfer members.

In the first aspect, the predetermined conditions may be the quantity of the printing medium or the temperature and humidity inside the color image forming apparatus According to the above aspect, the voltages applied to the transfer members are controlled on the basis of predetermined conditions such as the quantity of the printing medium and the temperature and humidity inside the color image forming apparatus. Thus, an image forming apparatus with a wide transfer latitude can be provided.

In the above aspects, the plural toner image forming units may be arranged in a substantially vertical direction along a conveyance path of the printing medium.

According to this aspect, it is easy to predict the affect of heat on the transfer members because the affect of the heat from the fixing unit to the transfer members is greatest from downstream to upstream of the conveyance direction, the opposite direction to the sequence of transfers.

In each of the above aspects, the transfer voltages may be lowered with substantially equal reductions between each pair of adjacent transfer members from upstream to downstream in the conveyance direction of the printing medium.

Thus, control can be simplified because setting can be performed simply by setting the voltage applied to the transfer member at the upstream side in the conveyance direction and setting amounts of change in the voltages between transfer members.

In each of the above aspects, the transfer members may be ion conductive.

By this variations in the resistance values of the transfer members become smaller.

In the above aspects, the reduction of the transfer voltage to the transfer member at the downstream side in the conveyance direction of the printing medium may be large in comparison to the reduction between other transfer members.

Thus, substantially accurate voltage setting can be performed even when the transfer member at the downstream side in the conveyance direction is affected by the heat of the fixing unit due to making the apparatus compact.

In each of the above aspects, the electrical resistance values of all of the transfer members may be substantially the same.

Thus, the cost of the parts can be reduced because parts having the same electrical resistance values can be used for the transfer members of all of the colors.

In the above aspects, the transfer voltages applied to the transfer members may be independently controllable.

Figure 5:
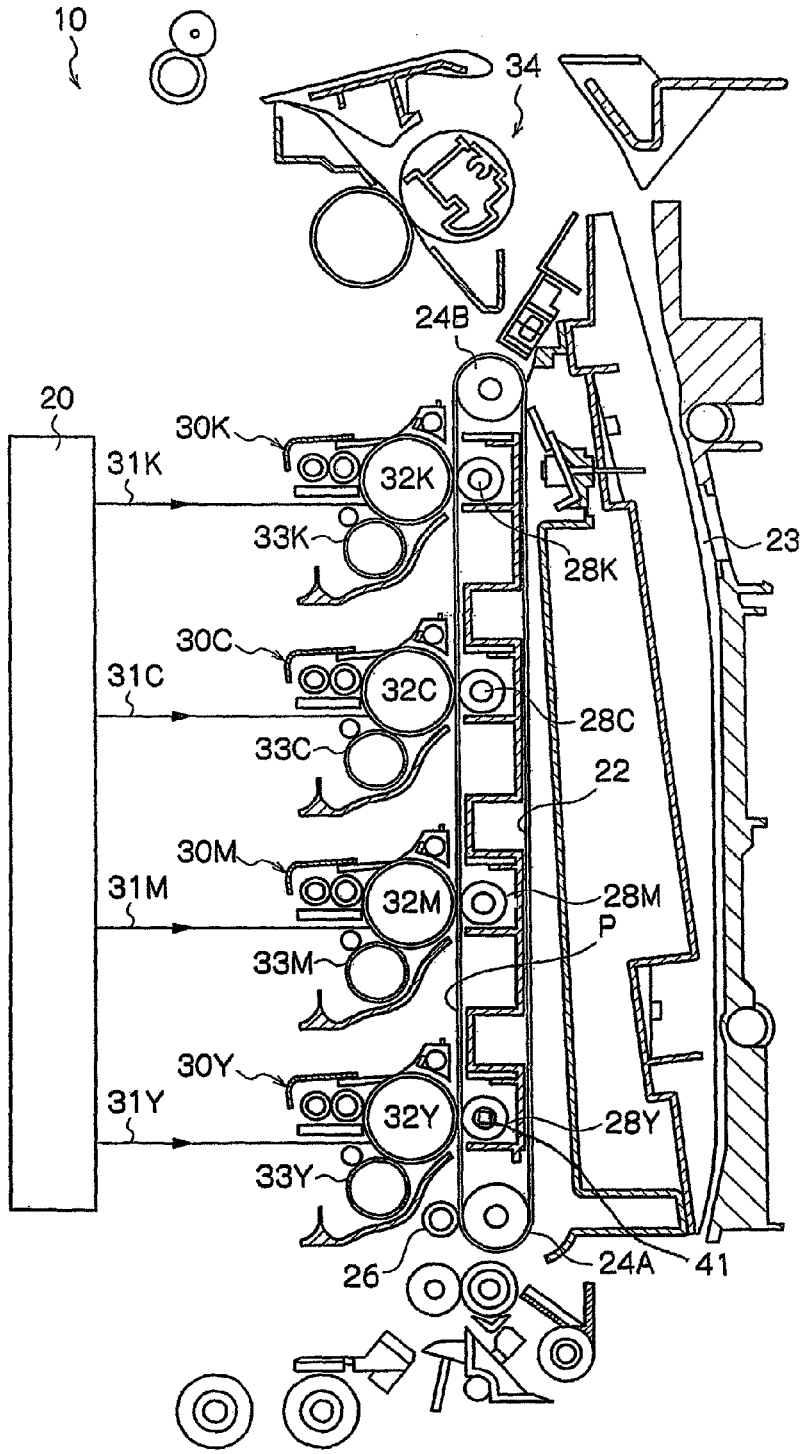
FIG. 5 is a cross-sectional view showing an image forming apparatus pertaining to a non-limiting embodiment of the present invention.

Further, the transfer member at an upstream side in the conveyance direction of the printing medium may be disposed with a detector 41 that detects electric current at the time of toner transfer (as shown in FIG. 5).

Additionally, a predetermined voltage may be applied to the transfer member at the upstream side in the conveyance direction of the printing medium, and then the transfer voltages applied to all of the transfer members may be determined on the basis of the electric current value detected by the detector 41.

According to these aspects, the transfer voltages are independently controlled per transfer member, and it becomes possible to perform electric current detection by the transfer member that is least affected by the heat of the fixing unit.

Thus, the cost can be reduced because it suffices for the detector 41 to be disposed just at the upstream side in the conveyance direction.

In the above aspects, control amounts of the transfer voltages may be corrected on the basis of circadian variations in the electric current detected by the detector 41.

Thus, it becomes possible to accommodate changes in the environment inside the apparatus, such as during large quantity processing.

In the above aspects, the image forming apparatus may further include an environment detector that detects the environment inside the apparatus, and control amounts of the transfer voltages may be corrected on the basis of the environmental conditions that the environment detector has detected.

Thus, precise control of the transfer voltages becomes possible.

What is claimed is:

1. A tandem electrophotographic image forming apparatus comprising:

a plurality of toner image forming units disposed in a conveyance direction of a printing medium, each of the toner image forming units including a photoreceptor on which a toner image is formed and an ion conductive transfer member to which a transfer voltage is applied to cause the toner image to be transferred from the photoreceptor onto the printing medium;

a fixing unit disposed at a downstream side of the toner image forming units in the conveyance direction of the printing medium, the fixing unit heating and fixing the toner images that have been transferred onto the printing medium; and a detecting unit provided at an upstream ion conductive transfer member at an upstream side in the conveyance direction of the printing medium and detecting an electric current at the time of toner transfer;

wherein the transfer voltages applied to the ion conductive transfer members are independently controlled such that:

the transfer voltages are made smaller the closer the ion conductive transfer member is to the fixing unit, a predetermined voltage is applied to the upstream ion conductive transfer member at the upstream side in conveyance direction of the printing medium, the transfer voltage applied to the upstream ion conductive transfer member at the upstream side in the conveyance direction of the printing medium is determined on the basis of an electric current value detected by the detecting unit, and the transfer voltages applied to the ion conductive transfer members other than the upstream ion conductive transfer member at the upstream side in the conveyance direction of the printing medium are corrected on the basis of an environmental temperature and a number of process sheets.

2. The image forming apparatus of claim 1, wherein the transfer voltages are lowered with substantially equal reductions between each pair of adjacent ion conductive transfer members from upstream to downstream in the conveyance direction of the printing medium.

3. The image forming apparatus of claim 1, wherein the reduction of the transfer voltage from the next to last ion conductive transfer member to the last ion conductive transfer member in the conveyance direction of the printing medium is larger than the reduction between other adjacent ion conductive transfer members.

4. The image forming apparatus of claim 1, wherein each of the toner image forming units transfers the toner image onto the printing medium.

5. A tandem electrophotographic image forming apparatus comprising:

a plurality of toner image forming units disposed in a conveyance direction of a printing medium, each of the toner image forming units including a photoreceptor on which a toner image is formed and an ion conductive transfer member to which a transfer voltage is applied to cause the toner image to be transferred from the photoreceptor onto the printing medium;

a fixing unit disposed at a downstream side of the toner image forming units in the conveyance direction of the printing medium, the fixing unit heating and fixing the toner images that have been transferred onto the printing medium; and a detecting unit provided at an upstream ion conductive transfer member at an upstream side in the conveyance direction of the printing medium and detecting an electric current at the time of toner transfer;

wherein the transfer voltages applied to the ion conductive transfer members are independently controlled such that:

the transfer voltage is made smallest at the ion conductive transfer member that is provided closest to the fixing unit, a predetermined voltage is applied to the upstream ion conductive transfer member at the upstream side in conveyance direction of the printing medium, the transfer voltage applied to the upstream ion conductive transfer member at the upstream side in the conveyance direction of the printing medium is determined on the basis of an electric current value detected by the detecting unit, and the transfer voltages applied to the ion conductive transfer members other than the upstream ion conductive transfer member at the upstream side in the conveyance direction of the printing medium are corrected on the basis of an environmental temperature and a number of process sheets.

* * * * *